US008272724B2

(12) United States Patent
Kanbe

(10) Patent No.: US 8,272,724 B2
(45) Date of Patent: Sep. 25, 2012

(54) LIQUID CONTAINERS

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 361 days.

(21) Appl. No.: 12/693,923

(22) Filed: Jan. 26, 2010

(65) Prior Publication Data

US 2010/0231667 A1 Sep. 16, 2010

(30) Foreign Application Priority Data

Mar. 16, 2009 (JP) ..... 2009-062415

(51) Int. Cl.
*B41J 2/175* (2006.01)

(52) U.S. Cl. ..... 347/86; 347/85

(58) Field of Classification Search ..... 347/84, 347/85, 86

See application file for complete search history.

(56) References Cited

U.S. PATENT DOCUMENTS

| | | | | |
|---|---|---|---|---|
| 5,801,737 | A * | 9/1998 | Sato et al. | 347/86 |
| 7,325,913 | B2 * | 2/2008 | Sasaki et al. | 347/86 |
| 7,645,033 | B2 * | 1/2010 | Bulman et al. | 347/86 |
| 2003/0142180 | A1 | 7/2003 | Gonzales | |
| 2004/0165043 | A1 | 8/2004 | Sakai et al. | |
| 2005/0134663 | A1 | 6/2005 | Sasaki et al. | |

FOREIGN PATENT DOCUMENTS

| | | | |
|---|---|---|---|
| JP | H09-141891 | A | 6/1997 |
| JP | 2004-249707 | A | 9/2004 |
| JP | 2005-153285 | A | 6/2005 |
| JP | 2005-178348 | A | 7/2005 |
| JP | 2007-500617 | T | 1/2007 |

* cited by examiner

*Primary Examiner* — Anh T. N. Vo
(74) *Attorney, Agent, or Firm* — Baker Botts L.L.P.

(57) ABSTRACT

A liquid container includes an air introduction portion configured to introduce air into a liquid chamber. The air introduction portion includes an air communication passage, and a blocking member positioned in the air communication passage and configured to block the air communication passage. The air introduction portion also includes a movable member positioned in the air communication passage and configured to move toward the blocking member, such that blockage of the air communication passage by the blocking member is released. The movable member includes an air passage formed therethrough, and the air passage is in fluid communication with the air communication passage. The air introduction portion further includes a gas-permeable film positioned on the movable member and closing the air passage.

9 Claims, 8 Drawing Sheets

LIQUID CONTAINERS

CROSS REFERENCE TO RELATED APPLICATION

The present application claims priority to and the benefit of Japanese Patent Application No. 2009-062415, which was filed on Mar. 16, 2009, the disclosure of which is incorporated herein by reference in its entirety.

BACKGROUND OF THE INVENTION

1. Field of the Invention

The present invention relates to liquid containers comprising an air introduction portion configured to introduce air into a liquid chamber.

2. Description of Related Art

Japanese Laid-Open Patent Publication No. 2005-153285 or its corresponding U.S. Patent Application Publication No. 2005/0134663 A1 describes an ink cartridge for use in an inkjet recording apparatus. The ink cartridge includes an ink supply portion, through which ink contained in an ink chamber is supplied to the inkjet recording apparatus. The ink cartridge further includes an air introduction portion configured to introduce air into the ink chamber. A valve is positioned in the air introduction portion. When the ink cartridge is mounted to the inkjet recording apparatus, the valve breaks a thin film member formed of resin material. Accordingly, the ink chamber is brought into fluid communication with the atmosphere via the air introduction portion. With this structure, the thin film member blocks ink until the ink cartridge is mounted to the inkjet recording apparatus, which reduces ink leakage to the exterior of the ink cartridge via the air introduction portion.

Nevertheless, once the film member breaks when the ink cartridge is mounted to the inkjet recording apparatus, the ink chamber is brought into fluid communication with the atmosphere. Therefore, if the inkjet recording apparatus is moved, ink may leak to the exterior of the ink cartridge via the air introduction portion. For example, if the inkjet recording apparatus is broken and the inkjet recording apparatus is sent for repair to its manufacturer with the ink cartridge mounted on the inkjet recording apparatus, the inkjet recording apparatus may be shaken hard or turned upside down during transportation. This may lead to ink leakage to the exterior of the ink cartridge.

Japanese Laid-Open Patent Publication No. 9-141891 describes an ink cartridge having a gas-permeable film attached to an air introduction portion which brings an ink chamber into fluid communication with the atmosphere. The gas-permeable film allows air to pass therethrough but prevent ink from passing therethrough. In this ink cartridge, the ink chamber always communicates with the atmosphere via the gas-permeable film, and ink leakage to the exterior of the ink cartridge may be reduced even after the ink cartridge is mounted to an inkjet recording apparatus.

As described above, when the gas-permeable film is simply attached to the air introduction portion, ink and the gas-permeable film are placed in a situation in which they may contact constantly. In such situation, for example, when the ink cartridge is transported from its manufacturer to a store which sells the ink cartridge, ink cartridge may be shaken hard enough to make ink contact with the gas-permeable film during transportation. Contact between ink and the gas-permeable film may cause ink meniscuses to be formed in pores in the gas-permeable film, which may prevent air from being introduced into the ink chamber. Ink and the gas-permeable film may contact before the ink cartridge is mounted to the inkjet recording apparatus. When such ink cartridge is mounted to the inkjet recording apparatus, and ink in the ink chamber is continued to be supplied to the inkjet recording apparatus, the pressure ink the ink chamber decreases because air cannot be introduced into the ink chamber. This pressure drop in the ink chamber may cause the inkjet recording apparatus to fail to perform printing properly.

Therefore, even when the gas-permeable film is used in the air introduction portion, it may be preferred to reduce opportunities that ink and the gas-permeable film contact with each other. In particular, before the ink cartridge is mounted to the inkjet recording apparatus, it may be desired to avoid contact between ink and the gas-permeable film.

Moreover, to reduce an installation space for the inkjet recording apparatus, demands on reduction in physical size of the inkjet recording apparatus are increasing recently. Accordingly, reduction in physical size of the ink cartridge also may be desired.

SUMMARY OF THE INVENTION

Therefore, a need has arisen for liquid containers which overcome these and other shortcomings of the related art. A technical advantage of the present invention is that a liquid container has a compact structure which may reduce leakage of liquid to the exterior of the liquid container before and after the liquid container is mounted to a liquid supply device.

According to an embodiment of the present invention, a liquid container comprises a case and a liquid chamber formed in the case. The liquid chamber is configured to store liquid therein. The liquid container further comprises a liquid supply portion configured to supply the liquid from the liquid chamber to an exterior of the case, and an air introduction portion configured to introduce air from the exterior of the case into the liquid chamber. The air introduction portion comprises an air communication passage formed in the case. The liquid chamber is configured to be in fluid communication with the exterior of the case through the air communication passage. The air communication passage has an air communication end, and extends from the air communication end to the liquid chamber, wherein the air communication end is open to the exterior of the case. The air introduction portion further comprises a blocking member positioned in the air communication passage, and configured to block the air communication passage. The air introduction portion also comprises a movable member positioned in the air communication passage between the air communication end and the blocking member, and configured to move toward the blocking member while contacting a wall defining the air communication passage, such that blockage of the air communication passage by the blocking member is released. The movable member comprises an air passage formed therethrough, and the air passage is in fluid communication with the air communication passage. The air introduction portion further comprises a gas-permeable film positioned on the movable member, and closing the air passage.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-8, like numerals being used for like corresponding parts in the various drawings.

Figure 1:
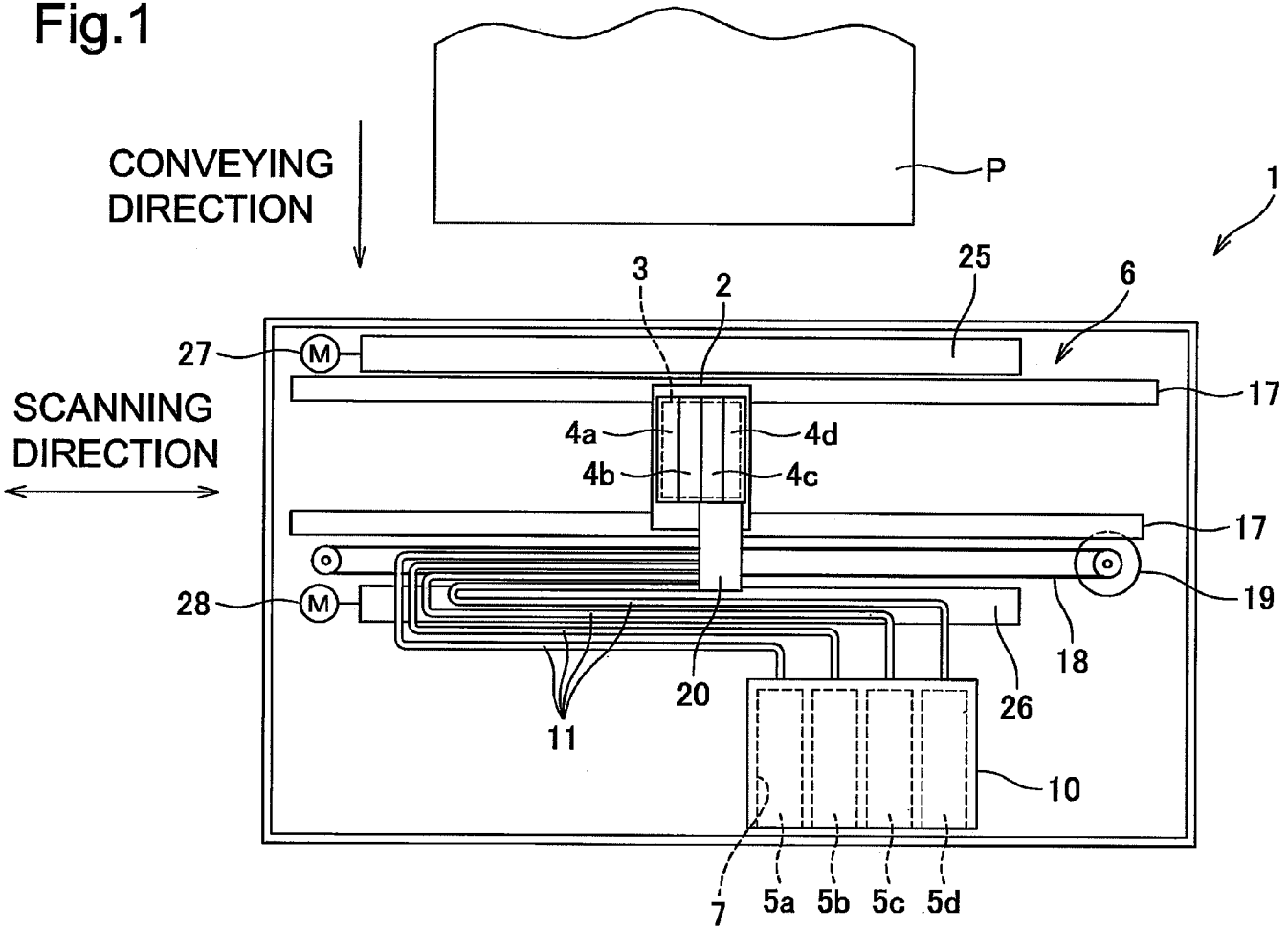
FIG. 1 is a plan view of a printer to which an ink cartridge according to an embodiment of the present invention is mounted.

Referring to FIG. 1, a liquid container, e.g., an ink cartridge 5, according to an embodiment of the present invention, may be mounted to a printer 1. Printer 1 may comprise a carriage 2 configured to reciprocate in a scanning direction, e.g., the right-left direction in FIG. 1, an inkjet head 3 and four sub-tanks 4*a*-4*d* mounted on carriage 2, a holder 10 configured to mount thereon four ink cartridges 5*a*-5*d*, and a conveying mechanism 6 configured to convey a recording sheet P in a conveying direction indicated in FIG. 1.

Carriage 2 may be configured to reciprocate along two guide shafts 17. Each shaft 17 may extend parallel to the scanning direction. An endless belt 18 may be coupled to carriage 2. A carriage drive motor 19 may be configured to drive endless belt 18. Carriage 2 may move in the scanning direction as endless belt 18 runs.

Inkjet head 3 may have ink ejection nozzles on its lower surface, e.g., on a reverse side of a sheet of FIG. 1. Four sub-tanks 4*a*-4*d* may be arranged in a row along the scanning direction. Sub-tanks 4*a*-4*d* may be integrally provided with a tube joint 20. Sub-tanks 4*a*-4*d* and holder 10 may be connected to each other by flexible tubes 11 coupled to tube joint 20.

Holder 10 may comprise a container mounting portion, e.g., a cartridge mounting portion 7. For example, four cartridge mounting portions 7 may be arranged in one direction, e.g., the scanning direction. Each cartridge mounting portion 7 may be configured to mount thereon one of four ink cartridges 5*a*-5*d*. Four ink cartridges 5*a*-5*d* may store different color inks, e.g., a black ink, a cyan ink, a magenta ink, and a yellow ink, respectively.

The color inks stored in four ink cartridges 5*a*-5*d* may be supplied to four sub-tanks 4*a*-4*d*, respectively, via respective tubes 11 coupled to holder 10. The inks may be temporarily stored in respective sub-tanks 4*a*-4*d* and then supplied to inkjet head 3. While inkjet head 3 reciprocates together with carriage 2 in the scanning direction, inkjet head 3 may eject ink droplets from the ink ejection nozzles, onto recording sheet P being conveyed by conveying mechanism 6 in the conveying direction. A liquid supply device, e.g., an ink supply device of printer 1 may comprise holder 10 comprising, e.g., four, cartridge mounting portions 7 and, e.g., four tubes 11.

Conveying mechanism 6 may comprise a feed roller 25 and an output roller 26 positioned upstream and downstream with respect to inkjet head 3 in the conveying direction, respectively. Feed motor 27 and output motor 28 may drive feed roller 25 and output roller 26, respectively. Feed roller 25 may feed recording sheet P in the conveying direction to inkjet head 3. Output roller 26 may convey recording sheet P having an image, text or combination thereof recorded by inkjet head 3, in the conveying direction.

Figure 2B:
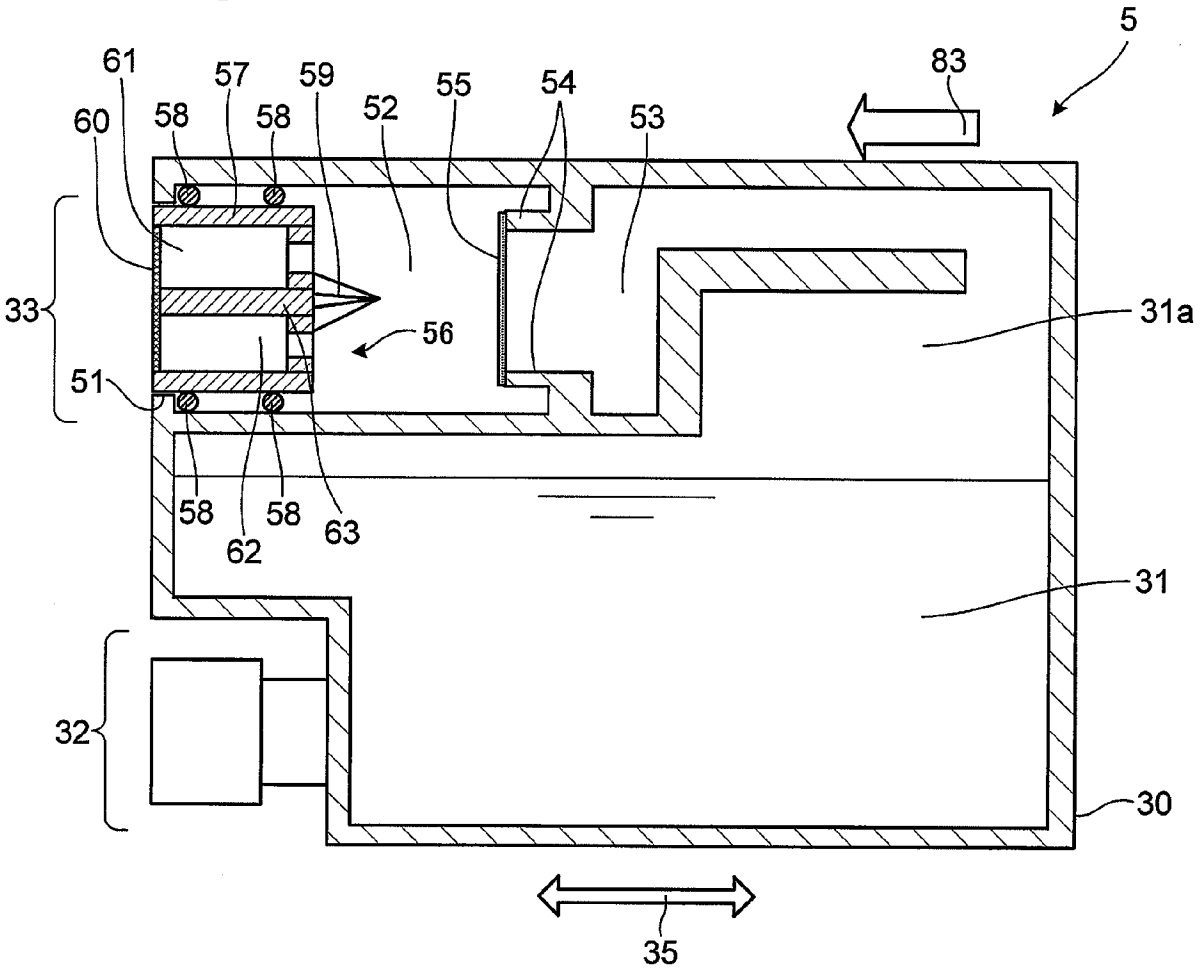
FIG. 2A and FIG. 2B are a front plan view and a side cross-sectional view of the ink cartridge configured to be mounted to the printer of FIG. 1, respectively.
Figure 2A:
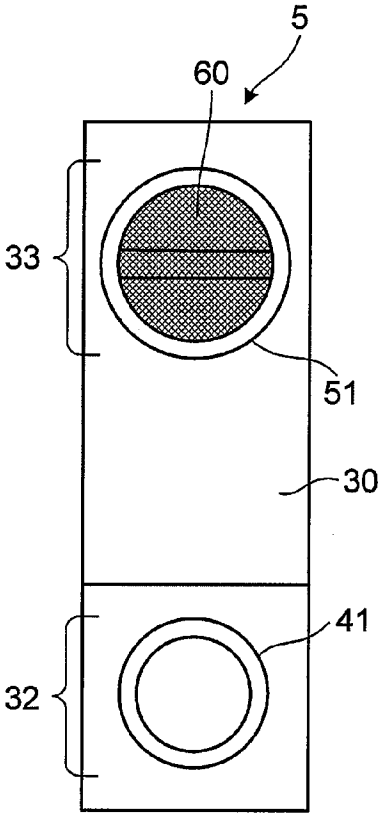

Four ink cartridges 5*a*-5*d*, containing different color inks, may have the same structure or similar structures. Therefore, referring to FIGS. 2A and 2B, one ink cartridge 5 is described in detail below. FIG. 2A shows a front plan view of ink cartridge 5. FIG. 2B shows a side cross-sectional view of ink cartridge 5 in which an ink supply portion 32 is shown in side view (not cross-sectional view). Ink cartridge 5 may be mounted to, e.g., be inserted into cartridge mounting portion 7 along a mounting direction 83, as indicated by an arrow in FIG. 2B, and be removed from cartridge mounting portion 7 in a direction opposite to mounting direction 83.

Ink cartridge 5 may comprise a case 30, a liquid chamber, e.g., an ink chamber 31, a liquid supply portion, e.g., ink supply portion 32, and an air introduction portion 33. Case 30 may comprise resin material, e.g., polyacetal, nylon, polyethylene or polypropylene. Ink chamber 31 may be formed in case 30 and configured to store ink therein. Ink supply portion 32 may be configured to supply ink from ink chamber 31 to the exterior of case 30, e.g., to the ink supply device of printer 1. Air introduction portion 33 may be configured to introduce air from the exterior of case 30 into ink chamber 31.

Unless otherwise specified, the front, rear, top and bottom of ink cartridge 5 may be defined in conjunction with an orientation in which ink cartridge 5 is mounted to cartridge mounting portion 7. More specifically, left, right, top, and bottom sides in FIG. 2B may be defined as front, rear, top, and bottom sides of ink cartridge 5, respectively. Therefore, an outer face of case 30 may comprise a front face facing forward with respect to mounting direction 83, i.e., the left face in FIG. 2B, a rear face opposite the front face and facing rearward with respect to mounting direction 83, i.e., the right face in FIG. 2B, a top face positioned at the top of case 30 when ink cartridge 5 is mounted to cartridge mounting portion 7, i.e., the top face in FIG. 2B, and a bottom face positioned at the bottom when ink cartridge 5 is mounted to cartridge mounting portion 7, i.e., the bottom face in FIG. 2B.

Ink supply portion 32 may be positioned at a lower portion of the front face of case 30 closer to the bottom face of case 30. Ink supply portion 32 may have a circular opening 41 formed therein. Ink supply portion 32 may comprise a communication passage (not shown) that may bring opening 41 and ink chamber 31 into fluid communication with each other and an ink supply valve (not shown) that may control the flow of ink in the communication passage. The ink supply valve may function as a valve mechanism that may open or close the communication passage.

Figure 3:
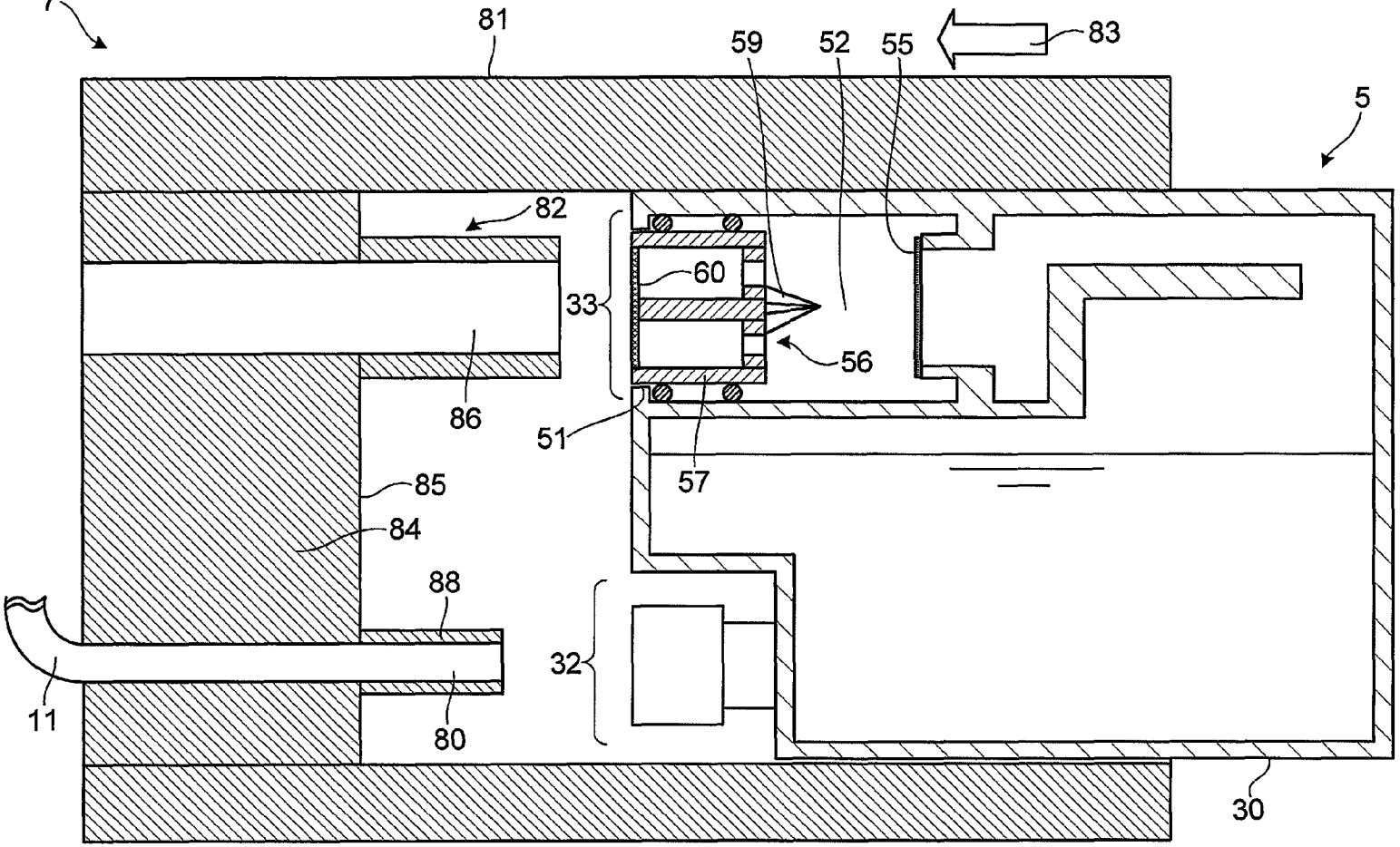
FIG. 3 is a side cross-sectional view of the ink cartridge of FIGS. 2A and 2B and a cartridge mounting portion of the printer of FIG. 1, in which the ink cartridge is being mounted to the cartridge mounting portion.
Figure 4:
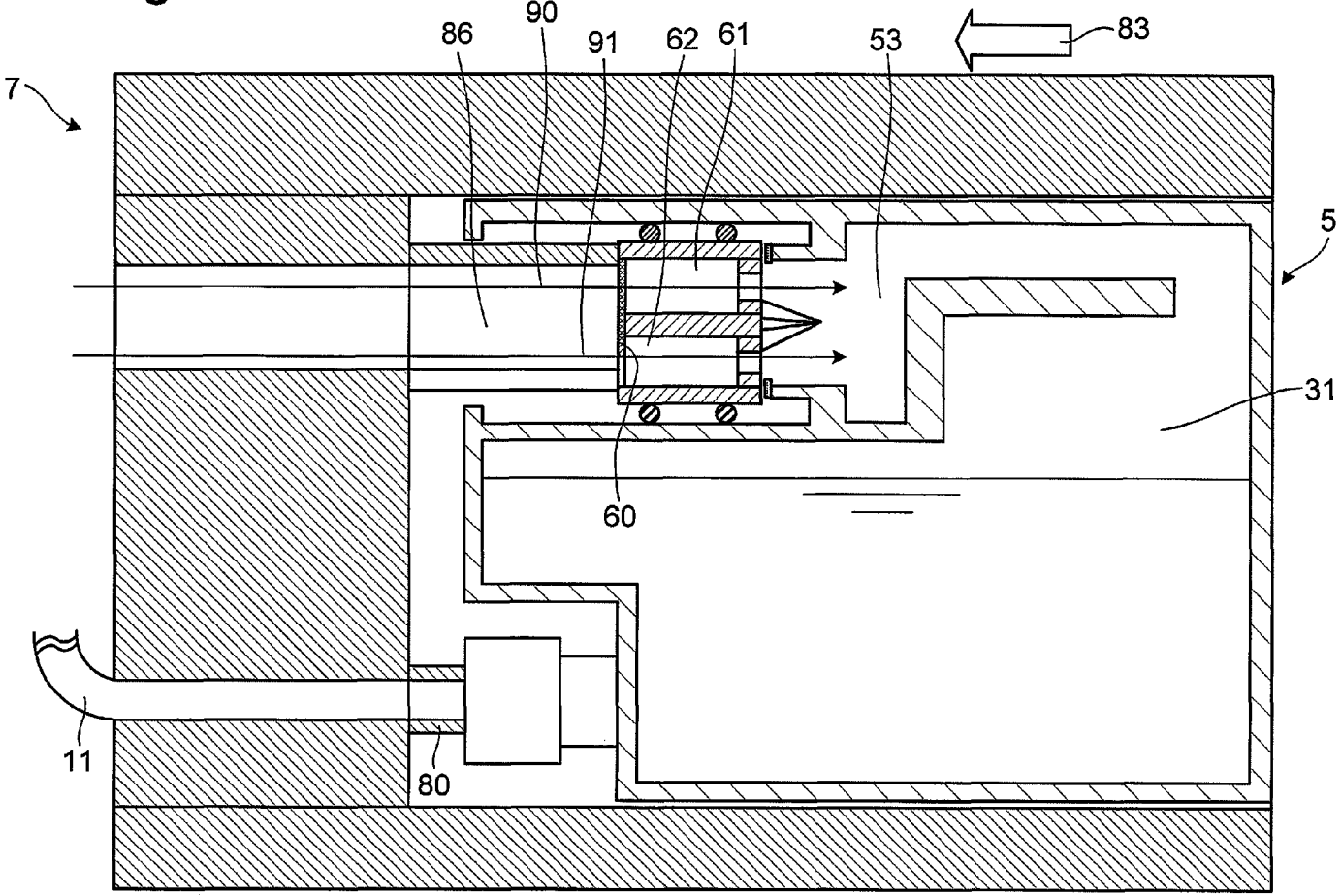
FIG. 4 is a side cross-sectional view of the ink cartridge of FIGS. 2A and 2B and the cartridge mounting portion of the printer of FIG. 1, in which mounting of the ink cartridge to the cartridge mounting portion has been completed.

Referring to FIGS. 3 and 4, when ink cartridge 5 is mounted to cartridge mounting portion 7, an ink tube 80 comprising resin material may be inserted into ink supply portion 32 through opening 41. When this occurs, the ink supply valve may open the communication passage, and ink stored in ink chamber 31 may be supplied to a corresponding one of sub-tanks 4*a*-4*d* via ink tube 80, tube 11, and tube joint 20.

Referring to FIGS. 2A and 2B, air introduction portion 33 may be positioned at an upper portion of case 30. Air introduction portion 33 may have a circular opening 51 formed in an upper portion of the front face of case 30 closer to the top face of case 30. Opening 51 may be formed through a front wall of case 30, which has the front face. Opening 51 may function as an air communication end that may be open to the exterior of case 30. Air introduction portion 33 may comprise cylindrical air communication passages 52, 53 formed in case 30. Air communication passage 52 may be formed continuously from opening 51 and connected to air communication passage 53 at an end opposite to opening 51. Air communication passages 52, 53 may extend in a depth direction 35, e.g., a front-rear direction, of case 30. Air communication passages 52, 53 may be in fluid communication with an upper portion 31*a* of ink chamber 31, at a position adjacent to the rear face of case 30. More specifically, air communication passages 52, 53 may be in fluid communication with airspace in upper portion 31*a*. A supporting portion 54 may be positioned between air communication passages 52, 53. Supporting portion 54 may support a blocking member, e.g., a film 55. Film 55 may block air communication passages 52, 53, and may divide air communication passages 52, 53 into air communication passage 52 and air communication passage 53. Film 55 may comprise resin material, and may not allow fluid, e.g., ink and air to pass therethrough. Ink chamber 31 may be kept sealed to the exterior of case 30 until film 55 breaks. More specifically, until film 55 breaks, film 55 and the ink supply valve positioned in ink supply portion 32 may prevent fluid communication between ink chamber 31 and the exterior of case 30, e.g., the atmosphere.

Air introduction portion 33 may comprise a movable member 56. Movable member 56 may be positioned in air communication passage 52 between opening 51 and film 55. Movable member 56 may be configured to be movable in air communication passage 52 extending from opening 51 to supporting portion 54 where film 55 is attached. Movable member 56 may comprise a main frame 57, a sealing member 58, a protrusion 59, and a gas-permeable film 60.

Main frame 57 may comprise resin material, e.g., polyacetal, nylon, polyethylene, or polypropylene. Main frame 57 may have a cylindrical shape. An outside diameter of main frame 57 may be smaller than a diameter of air communication passage 52. Main frame 57 may be configured to move in air communication passage 52 in depth direction 35. Main frame 57 may comprise air passages 61, 62 formed therethrough in depth direction 35. Air passages 61, 62 may fluidally communicate with air communication passage 52. Air passages 61, 62 may pass through main frame 57 in depth direction 35 from a first end of main frame 57 to a second end of main frame 57 opposite the first end. The first end of main frame 57 may be positioned closer to opening 51 than the second end of main frame 57 is, and the second end of main frame 57 may be positioned closer to film 55 than the first end of main frame 57 is. A partition plate 63 may be positioned between air passages 61, 62. Partition plate 63 may reinforce movable member 56 and support protrusion 59. Partition plate 63 may extend in depth direction 35 from the first end of main frame 57 to the second end of main frame 57.

Sealing member 58 may comprise a synthetic resin having elasticity. Sealing member 58 may have an O-ring shape. More specifically, sealing member 58 may have an annular cross section in a plane perpendicular to depth direction 35. Sealing member 58 may be positioned on and around an outer surface of main frame 57 to make intimate contact with an inner wall of case 30 defining air communication passage 52. A plurality of, e.g., two, sealing members 58, may be positioned with a distance therebetween in depth direction 35. Sealing members 58 may be elastically deformed between the wall of case 30 defining air communication passage 52 and the outer surface of main frame 57 without a gap therebetween. This may cause air communication passages 52, 53 to be tightly sealed to the exterior of case 30.

The shape of sealing member 58 may not be limited to an O-ring shape. In another embodiment, a sealing member may have any shape as long as it may be elastically deformed between the wall of case 30 defining air communication passage 52 and the outer surface of main frame 57 without a gap therebetween. In another embodiment, movable member 56 may not comprise a sealing member. In this case, main frame 57 may have an outside diameter approximately equal to a diameter of air communication passage 52. Main frame 57 may be pressed into air communication passage 52 to make intimate and direct contact with the wall of case 30 defining air communication passage 52 without a gap therebetween. This may cause air communication passages 52, 53 to be tightly sealed to the exterior of case 30.

Protrusion 59 may extend in depth direction 35 toward film 55 from a substantially central portion of the second end of main frame 57, i.e., an end of main frame 57 closer to film 55. Protrusion 59 may have a generally cross-shaped cross-section in a plane perpendicular to depth direction 35. Protrusion 59 may be tapered down to a pointed tip, e.g., a diameter of protrusion 59 may be reduced, as protrusion 59 becomes closer to film 55. The pointed tip of protrusion 59 may face film 55. When movable member 56 slides in air communication passage 52 toward film 55, the pointed tip of protrusion 59 may contact and break film 55.

Gas-permeable film 60 may be positioned at the first end of main frame 57 e.g., an end of main frame 57 closer to opening 51 to close air passages 61, 62. Gas-permeable film 60 may allow air to pass therethrough but prevent liquid, e.g., ink from passing therethrough at normal atmospheric pressure. Gas-permeable film 60 may be a porous film comprising, e.g., polytetrafluoroethylene (PTFE) or polypropylene (PP). Average diameters of pores in the porous film may be 0.2-5 μm. For example, FP022, FP100 or FP 500 manufactured by Sumitomo Electric Industries, Ltd. may be used for gas-permeable film 60.

Gas-permeable film 60 may not be limited to the above-described materials or structures, if a film allows air to pass therethrough but prevent ink from passing therethrough. Gas-permeable film 60 may comprise a porous film comprising e.g., polychlorotrifluoroethylene (PCTFE), tetrafluoroethylene-hexafluoropropylene copolymers, tetrafluoroethylene-perfluoro alkyl vinyl ether copolymer, or tetrafluoroethylene-ethylene copolymer. If the average diameters of pores in the porous film is less than 0.2 μm, air permeability may be reduced and it may be difficult to speedily equalize the pressure in ink chamber 31 to the atmospheric pressure. If the average diameters of pores in the porous film is greater than 5 μm, the porous film may tend to readily break because the film strength is reduced.

Ink cartridges 5*a*-5*d* may be mounted on respective cartridge mounting portions 7. Each cartridge mounting portion 7 may have the same structure or similar structures. Therefore, referring to FIG. 3, one cartridge mounting portion 7 is described in detail below.

Cartridge mounting portion 7 may comprise a frame 81 having an open-box shape with an open end or an angular C shape when viewed in cross-section. An interior of frame 81 may be a space for accommodating ink cartridge 5.

Frame 81 may comprise a mounting unit 84 positioned at an end of frame 81 opposite to the open end. Mounting unit 84 may comprise a wall surface 85 and a pushing portion 82. Wall surface 85 may face the front face of case 30 of ink cartridge 5 when ink cartridge 5 is mounted to cartridge mounting portion 7. Pushing portion 82 may be positioned at an upper portion of wall surface 85 in correspondence with air introduction portion 33. Pushing portion 82 may push main frame 57 of movable member 56 via opening 51 when ink cartridge 5 is inserted into cartridge mounting portion 7.

Pushing portion 82 may have a cylindrical shape protruding perpendicularly from wall surface 85. Pushing portion 82 may be inserted through opening 51 during insertion of ink cartridge 5 into cartridge mounting portion 7. The length of pushing portion 82 may be set such that pushing portion 82 may be first inserted into opening 51, when ink cartridge 5 is inserted into cartridge mounting portion 7, before other portions of cartridge mounting portion 7 contact ink cartridge 5.

Pushing portion 82 may have an inner opening 86 formed therethrough. Inner opening 86 may allow air to pass therethrough. Inner opening 86 may pass through pushing portion 82 from an end of pushing portion 82 to a rear side of mounting unit 84, e.g., a side of mounting unit 84 opposite to wall surface 85. Inner opening 86 may fluidally communicate with the exterior of cartridge mounting portion 7 at the rear side of mounting unit 84. Referring to FIG. 4, when ink cartridge 5 has been mounted to cartridge mounting portion 7, inner opening 86 may fluidally communicate with air passages 61, 62, via gas-permeable film 60.

Referring to FIGS. 3 and 4, an ink tube 80 may be positioned at a lower portion of wall surface 85 in correspondence with ink supply portion 32 of ink cartridge 5. Ink tube 80 may be coupled to ink supply portion 32 when ink cartridge 5 is mounted to cartridge mounting portion 7. Ink tube 80 may comprise resin material. Ink tube 80 may be coupled to flexible tube 11 at the rear side of mounting unit 84.

In FIGS. 3 and 4, only ink supply portion 32 is shown in side view whereas other portions of ink cartridge 5 and cartridge mounting portion 7 are shown in cross section.

Referring to FIGS. 3 and 4, when ink cartridge 5 is inserted into cartridge mounting portion 7, the front face of case 30 of ink cartridge 5 may face wall surface 85 of mounting unit 84. When ink cartridge 5 is further inserted into cartridge mounting portion 7 in mounting direction 83, pushing portion 82 may be first inserted into opening 51 of ink cartridge 5. When this occurs, an end of pushing portion 82 may contact movable member 56.

When ink cartridge 5 is further inserted into cartridge mounting portion 7 in mounting direction 83 toward wall surface 85 with the end of pushing portion 82 contacting movable member 56, only case 30 may move in mounting direction 83, e.g., case 30 may approach mounting unit 84, while movable member 56 contacts pushing portion 82.

Pushing portion 82 contacting movable member 56 may move relative to case 30 in air communication passage 52 toward film 55. In other words, movable member 56 may move in a direction opposite to mounding direction 83. When ink cartridge 5 is further inserted into mounting direction 83 with the end of pushing portion 82 contacting movable member 56, protrusion 59 positioned at the second end of movable member 56 may contact and break film 55. Consequently, as shown by arrows 90, 91 in FIG. 4, ink chamber 31 may be brought into fluid communication with the atmosphere, via air communication passage 53, air passages 61, 62, gas-permeable film 60, and inner opening 86. Thus, air may be introduced from the exterior of case 30 into ink chamber 31, via gas-permeable film 60.

When ink cartridge 5 moves toward wall surface 85, ink tube 80 may be inserted through opening 41 into ink supply portion 32. When ink tube 80 is thus inserted into ink supply portion 32, the ink supply valve may open the communication passage extending from opening 41 to ink chamber 31. Thus, ink in ink chamber 31 may be supplied to inkjet head 3, via ink supply portion 32, ink tube 80, tube 11, tube joint 20 and sub-tank 4 (4*a*-4*d*).

Ink stored in ink chamber 31 may be supplied to ink tube 80 after film 55 breaks and air is introduced into ink chamber 31. Before film 55 breaks, the pressure in ink chamber 31 may have been reduced to keep ink in ink chamber 31 deaerated. Therefore, if ink stored in ink chamber 31 should be supplied to ink tube 80 before air is introduced into ink chamber 31, ink or air may flow back into ink chamber 31 from tube 11.

In ink cartridge 5 according to the above-described embodiment, when movable member 56 moves while intimately contacting the wall of case 30 defining air communication passage 52, protrusion 59 may break film 55, which may be positioned closer to an end of air communication passages 52, 53 connected to ink chamber 31 than movable member 56 is positioned. Thus, blockage of air communication passages 52, 53 by film 55 may be released. Before ink cartridge 5 is mounted to cartridge mounting portion 7, film 55 may block or prevent fluid communication between ink chamber 31 and the atmosphere, and ink leakage to the exterior of ink cartridge 5 may be reduced. When ink cartridge 5 is mounted to cartridge mounting portion 7, movable member 56 may move such that the blockage of air communication passages 52, 53 by film 55 may be released. Thus, air may be introduced into ink chamber 31, via gas-permeable film 60 positioned at movable member 56 and closing air passages 61, 62. Gas-permeable film 60 may reduce leakage of ink from ink chamber 31 to the exterior of ink cartridge 5.

Sealing member 58 may be elastically deformed between the wall of case 30 defining air communication passage 52 and the outer surface of main frame 57. This may increase sealing performances between the wall of case 30 defining air communication passage 52 and the outer surface of main frame 57, and ink may not leak to the exterior of ink cartridge 5 through a gap formed therebetween.

Movable member 56 may comprise air passages 61, 62 and gas-permeable film 60 closing air passages 61, 62. With such compact structure, leakage of ink from ink chamber 31 to the exterior of ink cartridge 5 may be reduced.

The blockage of air communication passages 52, 53 may be released with a relatively simple structure, e.g., film 55 and protruding portion 55. Thus, ink cartridge 5 may be manufactured compactly with reduced costs.

Movable member 56 may be configured to contact pushing portion 82 and move relative to case 30 in a direction opposite to mounting direction 83 when ink cartridge 5 is mounted to cartridge mounting portion 7 in mounting direction 83. Such structure may enable air to be automatically introduced into ink chamber 31 when ink cartridge 5 is mounted to cartridge mounting portion 7. Thus, an operation other than mounting ink cartridge 5 to cartridge mounting portion 7 may not be required to release the blockage of air communication passages 52, 53 by film 55.

When ink cartridge 5 has been mounted to cartridge mounting portion 7, gas-permeable film 60 may be positioned at an upper portion of ink cartridge 5. Therefore, chances that ink stored in ink chamber 31 reaches gas-permeable film 60 may be low. If a user carries printer 1 from one place, e.g., a desk or table, to another, it may be rare for printer 1 to be shaken hard or turned upside down. Therefore, chances that ink stored in ink chamber 31 reaches gas-permeable film 60 may be low. If printer 1 is broken, a user may send printer 1 to its manufacturer for repair with ink cartridge 5 mounted on printer 1. During transportation, printer 1 may be shaken hard or turned upside down, and ink in ink chamber 31 may reach and contact gas-permeable film 60. Nevertheless, gas-permeable film 60 may reduce leakage of ink to the exterior of ink cartridge 5. Thus, an interior of printer 1 or packing materials for printer 1 may not be contaminated with ink. If ink contacts gas-permeable film 60, air may not be introduced into ink chamber 31 any more. Nevertheless, when printer 1 has reached the manufacturer, ink cartridge 5 may be removed from printer 1 for repair and would not be reused. Thus, users would not experience any inconvenience caused by ink cartridge 5 in which ink contacts gas-permeable film 60.

Figure 5B:
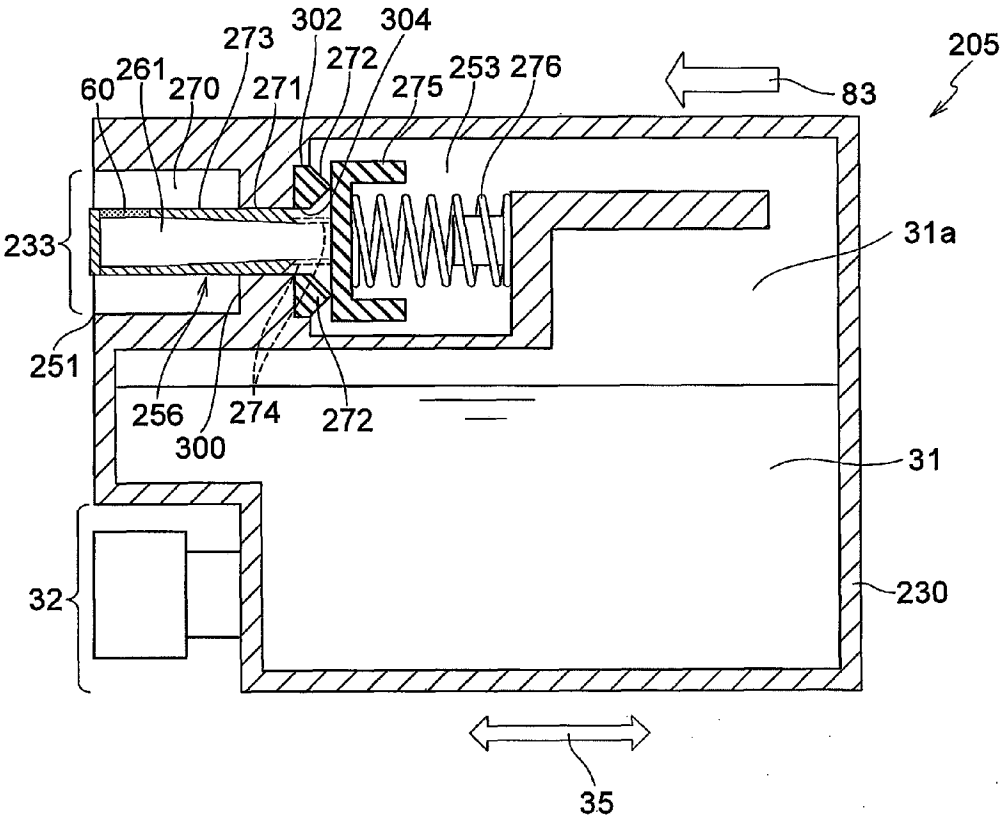
FIG. 5A and FIG. 5B are a front plan view and a side cross-sectional view of an ink cartridge of another embodiment of the present invention, respectively.
Figure 5A:
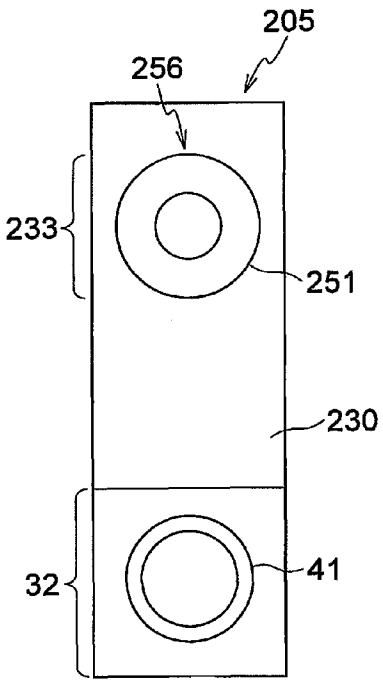
Figure 6:
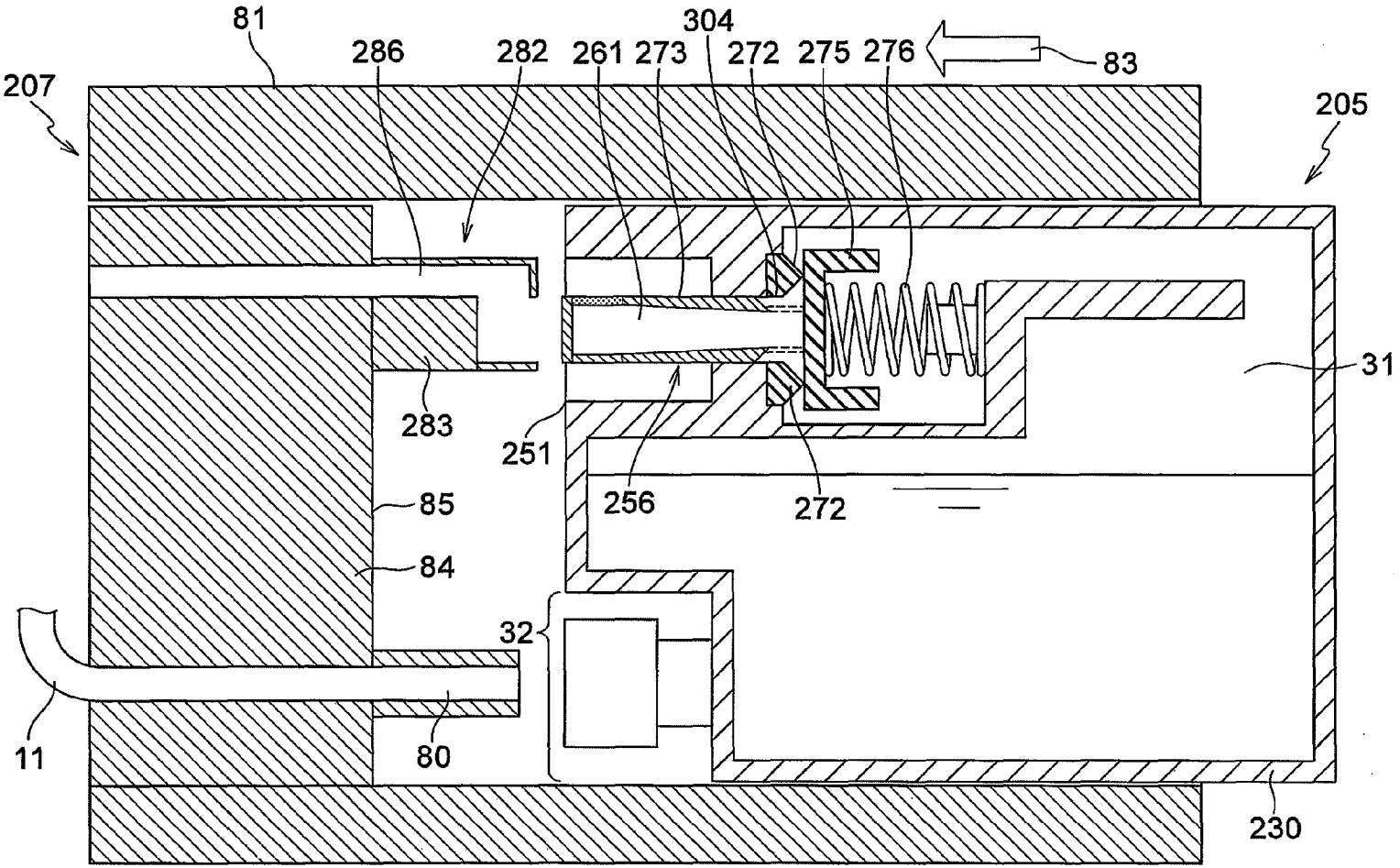
FIG. 6 is a side cross-sectional view of the ink cartridge of FIGS. 5A and 5B and a cartridge mounting portion according to another embodiment of the present invention, in which the ink cartridge is being mounted to the cartridge mounting portion.
Figure 7:
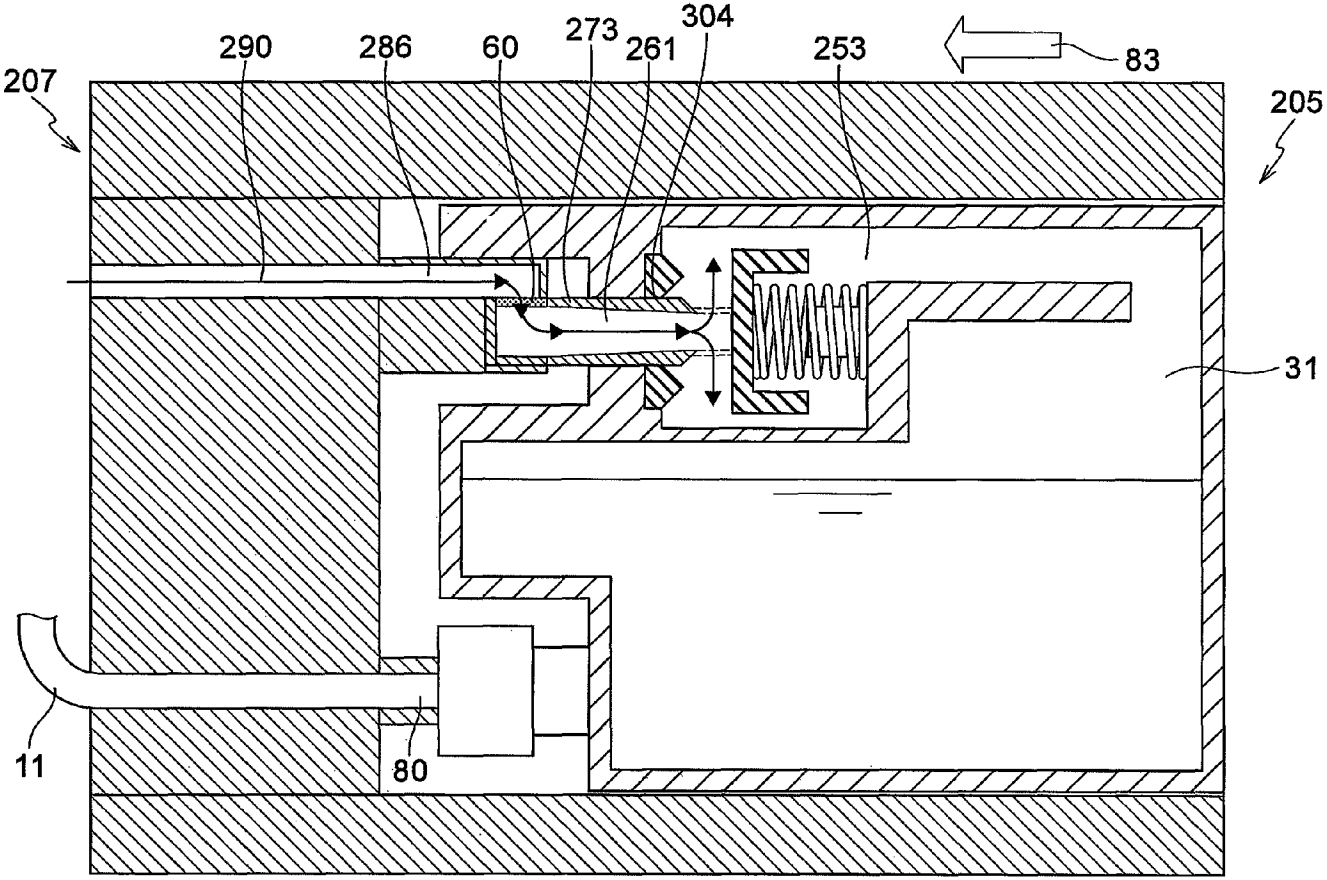
FIG. 7 is a side cross-sectional view of the ink cartridge of FIGS. 5A and 5B and the cartridge mounting portion of FIG. 6, in which mounting of the ink cartridge to the cartridge mounting portion has been completed.

Referring to FIGS. 5A-7, a liquid container, e.g., an ink cartridge 205 according to another embodiment is described. Ink cartridge 205 may be configured to be mounted to a container mounting portion, e.g., a cartridge mounting portion 207. In FIG. 5B, an ink supply portion 32 of ink cartridge 205 is shown in side view whereas other portions of ink cartridge 205 are shown in cross section. In FIG. 7, ink supply portion 32 of ink cartridge 205 is shown in side view whereas other portions of ink cartridge 205 and cartridge mounting portion 207 are shown in cross section. Ink cartridge 205 and cartridge mounting portion 207 may be similar to ink cartridge 5 and cartridge mounting portion 7, respectively. Therefore, only differences are discussed with respect to ink cartridge 205 and cartridge mounting portion 207.

Referring to FIGS. 5A and 5B, ink cartridge 205 may comprise a case 230, a liquid chamber, e.g., an ink chamber 31, a liquid supply portion, e.g., ink supply portion 32, and an air introduction portion 233. Ink chamber 31 may be formed in case 230 and configured to store ink therein. Ink supply portion 32 may supply ink from ink chamber 31 to the exterior of case 230, e.g., the ink supply system of printer 1. Air introduction portion 233 may introduce air from the exterior of case 230 into ink chamber 31.

Ink supply portion 32 may be positioned at a lower portion of a front face of case 230 closer to a bottom face of case 230. Ink supply portion 32 according to this embodiment may be the same as or similar to ink supply portion 32 of the above-embodiment, and the description thereof is omitted.

Air introduction portion 233 may be positioned at an upper portion of case 230. Air introduction portion 233 may have a circular opening 251 formed at an upper portion of the front face of case 230 closer to a top face of case 230. Opening 251 may be formed through a front wall of case 230 having the front face. Opening 251 may function as an air communication end that may be open to the exterior of case 230. Opening 251 may be configured to receive a pushing portion 282. A cylindrical insertion passage 270 as a portion of an air communication passage may extend in case 230 continuously from opening 251 in depth direction 35. An end of insertion passage 270 opposite to opening 251 may be defined by a partition wall 300. A cylindrical slide passage 271 also as a portion of an air communication passage may pass through partition wall 300 in depth direction 35. A movable member, e.g., a tubular portion 273 of a movable valve 256 may be inserted through slide passage 271. Slide passage 271 may fluidally communicate with an air communication passage 253 formed inside case 230 at an end opposite to insertion passage 270. Air communication passage 253 may be in fluid communication with an upper portion 31*a* of ink chamber 31 at a position adjacent to a rear face of case 230. More specifically, air communication passage 253 may be in fluid communication with airspace in upper portion 31*a*. An annular recess 302 may be formed in a portion of partition wall 300 at an outer rim of an end or an exit of slide passage 271 to air communication passage 253. An annular valve seat 272 may be positioned, e.g., fitted in recess 302. Valve seat 272 may comprise an elastic material, e.g., resin or rubber, having elasticity. An outside diameter of valve seat 272 before it is positioned in recess 302 may be greater than an diameter of recess 302. Valve seat 207 may be fitted into recess 302 while valve seat 207 is elastically deformed. Valve seat 272 may have a cylindrical through hole 304 passing though valve seat 272 in depth direction 35. Through hole 304 may be a portion of the air communication passage.

Movable valve 256 may be positioned in insertion passage 270, slide passage 271 and air communication passage 253. Movable valve 256 may comprise a movable member, e.g., a tubular portion 273, a gas-permeable film 60, a valve body 275, and an urging member, e.g., a spring 276. Tubular portion 273 may have a cylindrical shape. Gas-permeable film 60 may be positioned at tubular portion 273. Valve body 275 may be configured to make contact with valve seat 272. Spring 275 may urge valve body 275 toward valve seat 272. Tubular portion 273 and valve body 275 may comprise resin material, e.g., polyacetal, nylon, polyethylene, or polypropylene. Spring 276 may be, for example, a metal coil spring.

Tubular portion 273 may be inserted into slide passage 271 and through hole 304. Tubular portion 273 may be configured to slide in depth direction 35 on a wall defining slide passage 271 and/or on a portion of valve seat 272 defining through hole 304. Tubular portion 273 may extend in mounting direction 83 from valve body 275 through through hole 304 and slide passage 271. Tubular portion 273 may be configured to move together with valve body 275 while making intimate contact with the wall defining slide passage 271 and/or with the portion of valve seat 272 defining through hole 304.

Tubular portion 273 may comprise an air passage 261 formed therein and extending in depth direction 35. An upper portion of tubular portion 273 adjacent to the front face of case 230 may have an opening communication with air passage 261. The opening may be covered and closed by gas-permeable film 60. Air may move between air passage 261 and the exterior of tubular portion 273 via gas-permeable film 60. An outside diameter of an end of tubular portion 273 connected to valve body 275 may be less than outer diameters of other portions of tubular portion 273, and this end of tubular portion 273 may have slits 274 formed therethrough. Air passage 261 may fluidally communicate with the exterior of tubular portion 273 via slits 274. The width of air passage 261 may increase toward gas-permeable film 60 from a portion corresponding to slits 274 formed in tubular portion 273. The width of air passage 261 is a dimension in a direction perpendicular to mounting direction 83 or perpendicular to depth direction 35.

Similarly to the before-described embodiment, gas-permeable film 60 may be a porous film comprising, e.g., polytetrafluoroethylene (PTFE) or polypropylene (PP). Gas-permeable film 60 may allow air to pass therethrough but prevent liquid, e.g., ink from passing therethrough at normal atmospheric pressure. Average diameters of pores in the porous film may be 0.2-5 μm.

Valve body 275 may contact valve seat 272 to block slide passage 271 and air communication passage 253. Valve body 275 may be connected to an end of tubular portion 273 closer to the rear face of case 230. Valve body 275 may comprise a surface to which annular valve seat 272 may closely contact. The area of the surface of valve body 275 may be greater than an area of a contact surface of valve seat 272 contacting valve body 275. Spring 276 may be configured to urge valve body 275 toward valve seat 272.

Referring to FIG. 6, ink cartridges 205 may be configured to be mounted to cartridge mounting portions 207. Cartridge mounting portion 207 may comprise a frame 81 having an open-box shape with an open end or an angular C shape when viewed in cross-section. An interior of frame 81 may be a space for accommodating ink cartridge 205.

Frame 81 may comprise a mounting unit 84 positioned at an end of frame 81 opposite to the open end. Mounting unit 84 may comprise a wall surface 85 and a pushing portion 282. Wall surface 85 may face the front face of case 230 of ink cartridge 205 when ink cartridge 205 is mounted to cartridge mounting portion 207. Pushing portion 282 may be positioned at an upper portion of wall surface 85 in correspondence with air introduction portion 233. Pushing portion 282 may push tubular portion 273 of movable valve 256 via opening 251 when ink cartridge 205 is inserted into cartridge mounting portion 207.

Pushing portion 282 may have a cylindrical shape protruding perpendicularly from wall surface 85. An interior of pushing portion 282 may comprise a contact portion 283 configured to directly contact tubular portion 273 of movable valve 256 when ink cartridge 205 is inserted into cartridge mounting portion 207. Pushing portion 282 may extend in a direction opposite to direction 83. Pushing portion 282 may be inserted through opening 251 of air introduction portion 233 during insertion of ink cartridge 205 into cartridge mounting portion 207. The length of pushing portion 282 may be set such that pushing portion 282 be first inserted into opening 251, when ink cartridge 205 is inserted into cartridge mounting portion 207, before other portions of cartridge mounting portion 207 contact ink cartridge 205.

Pushing portion 282 may have an inner opening 286 formed therein. Inner opening 286 may allow air to pass therethrough. Inner opening 286 may pass through pushing portion 282 from an end of pushing portion 282 to a rear side of mounting unit 84, e.g., a side of mounting unit 84 opposite to wall surface 85. Inner opening 286 may fluidally communicate with the exterior of cartridge mounting portion 207 at the rear side of mounting unit 84. Referring to FIG. 7, when ink cartridge 205 has been mounted to cartridge mounting portion 207, inner opening 286 may fluidally communicate with air passage 261 positioned in tubular portion 273, via gas-permeable film 60.

Referring to FIGS. 6 and 7, an ink tube 80 may be positioned at a lower portion of wall surface 85 of mounting unit 84 in correspondence with ink supply portion 32 of ink cartridge 205, similarly to the before-described embodiment.

In FIGS. 6 and 7, only ink supply portion 32 is shown in side view whereas other portions of ink cartridge 205 and cartridge mounting portion 207 are shown in cross section.

Referring to FIGS. 6 and 7, when ink cartridge 205 is inserted into cartridge mounting portion 207, the front face of case 230 of ink cartridge 205 may face wall surface 85 of mounting unit 84. When ink cartridge 205 is further inserted into cartridge mounting portion 207 in mounting direction 83, pushing portion 282 may be first inserted through opening 251 of ink cartridge 205. When this occurs, contact portion 283 positioned in pushing portion 282 may contact tubular portion 273 of movable valve 256.

When ink cartridge 205 is further inserted into cartridge mounting portion 207 in mounting direction 83 toward wall surface 85 with contact portion 283 of pushing portion 282 contacting tubular portion 273, only case 230 may move in mounting direction 83, e.g., case 230 may approach mounting unit 84, while movable valve 256 contacts pushing portion 282.

Valve body 275 and tubular portion 273 contacting contact portion 283 may move relative to case 230 against the urging force of spring 276. In other words, tubular portion 273 and valve body 275 may move relative to case 230 in a direction opposite to mounding direction 83. When ink cartridge 205 is inserted into mounting direction 83 with pushing portion 282 contacting movable valve 256, valve body 275, which may closely contact valve seat 272 with the urging force of spring 276, may move relative to case 230 in a direction opposite to mounting direction 83. Thus, valve body 275 may move away from valve seat 272. Consequently, as shown by an arrow 290 in FIG. 7, ink chamber 31 may fluidally communicate with the atmosphere, via air communication passage 253, air passage 261, gas-permeable film 60 and inner opening 286. Thus, air may be introduced from the exterior of case 230 into ink chamber 31 via gas-permeable film 60, as indicated by arrow 290. Tubular portion 273 may move while making intimate contact with a portion of valve seat 272 defining though hole 304. When tubular portion 273 makes intimate contact with the portion of valve seat 272 defining though hole 304, valve seat 272 may elastically deform. This may increase sealing performance between valve seat 272 and tubular portion 273.

When ink cartridge 205 moves toward wall surface 85, ink tube 80 may be inserted into ink supply portion 32. Thus, ink in ink chamber 31 may be supplied to inkjet head 3, via ink supply portion 32, ink tube 80, tube 11, tube joint 20 and sub-tank 4 (4*a*-4*d*). Ink cartridge 205 may be held in cartridge mounting portion 207 in a state shown in FIG. 7, by a holding mechanism (not shown), when ink cartridge 205 is used in printer 1.

In ink cartridge 205 according to this embodiment, while tubular portion 273 moves toward valve body 275, valve body 275 may move away from valve seat 272 against the urging force of spring 276 to open the air communication passage comprising insertion passage 270, slide passage 271, and air communication passage 253, i.e. blockage of the air communication passage by valve seat 272, valve body 275, and spring 276 may be released. Thus, air may be introduced into ink chamber 31, via gas-permeable film 60 positioned at air passage 261, which may be formed in tubular portion 273. Gas-permeable film 60 may reduce leakage of ink from ink chamber 31 to the exterior of ink cartridge 205. When the urging force of spring 276 is greater than the force applied to tubular portion 273, valve body 275 may make intimate contact with valve seat 272, to block the air communication passage comprising insertion passage 270, slide passage 271, and air communication passage 253.

Elastic deformation of valve seat 272 may increase sealing performance between valve seat 272 and tubular portion 273. Therefore, ink may not leak out of ink cartridge 205 via a gap formed between valve seat 272 and tubular portion 273.

Because valve seat 272 may be an elastic member, the airtightness may increase when valve seat 272 contacts valve body 275.

The width of air passage 261 may increase toward gas-permeable film 60 from a portion corresponding to slits 274 formed in tubular portion 273. Therefore, even when ink enters into air passage 261, ink may be pulled toward a narrower portion of air passage 261 because the capillary force may be greater in the narrower portion than a wider portion of air passage 261. Thus, ink may not readily adhere to gas-permeable film 60.

Figure 8:
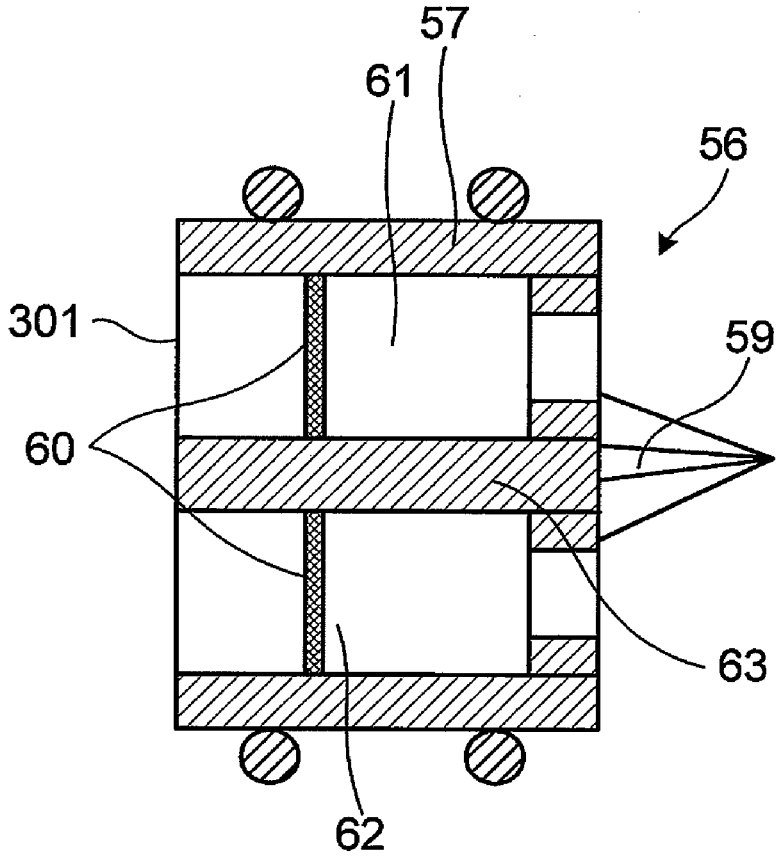
FIG. 8 is a side cross-sectional view of a modified movable member of the ink cartridge of FIGS. 2A and 2B.

The present invention is not limited to the above-described embodiments. Various modifications may be applied. For example, referring to FIG. 2, gas-permeable film 60 may be positioned at the first end of main frame 57 of movable member 56 closer to opening 51. Nevertheless, as shown in FIG. 8, gas-permeable film 60 may be positioned in air passages 61, 62 away from an opening ends 301 of air passages 61, 62, which are positioned at the first end of main frame 57. With this structure, pushing portion 82 may contact a portion of main frame 57 defining opening ends 301 of air passages 61, 62. Even when the portion of main frame 57 receives pushing force from pushing portion 82, gas-permeable film 60 may not directly receive the pushing force. Therefore, gas-permeable film 60 may not break.

Movable member 56 may be configured to contact pushing portion 82 and move in a direction opposite to mounting direction 83 when ink cartridge 5 is inserted into cartridge mounting portion 7 in mounting direction 83. Nevertheless, a user may push movable member 56 to break film 55, such that the blockage of air communication passages 52, 53 by film 55 is released. To improve operability, movable member 56 may comprise a protrusion that may protrude outside case 30 for a user to push.

Ink cartridge 5, 205 may be inserted in a horizontal direction into cartridge mounting portion 7, 207, respectively. Nevertheless, ink cartridge 5, 205 may be inserted in a vertical direction into cartridge mounting portion 7, 207, respectively.

The invention may be applied to ink cartridge 5, 205 for use in printer 1. Nevertheless, the invention may be applied to containers configured to contain liquid, regardless of usages of the containers or types of liquid contained in the containers.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid container comprising:

a case;

a liquid chamber formed in the case, and configured to store liquid therein;

a liquid supply portion configured to supply the liquid from the liquid chamber to an exterior of the case;

an air introduction portion configured to introduce air from the exterior of the case into the liquid chamber;

wherein the air introduction portion comprises:

an air communication passage formed in the case, wherein the liquid chamber is configured to be in fluid communication with the exterior of the case through the air communication passage, wherein the air communication passage has an air communication end, and extends from the air communication end to the liquid chamber, wherein the air communication end is open to the exterior of the case;

a blocking member positioned in the air communication passage, and configured to block the air communication passage;

a movable member positioned in the air communication passage between the air communication end and the blocking member, and configured to move toward the blocking member while contacting a wall defining the air communication passage, such that blockage of the air communication passage by the blocking member is released, wherein the movable member comprises an air passage formed therethrough, and the air passage is in fluid communication with the air communication passage; and a gas-permeable film positioned on the movable member, and closing the air passage.

2. The liquid container according to claim 1, wherein the liquid container is configured to be mounted to a container mounting portion of a liquid supply device in a mounting direction, wherein when the liquid container is mounted to the container mounting portion, the movable member is configured to move relative to the case in a direction opposite to the mounting direction while the movable member contacts the container mounting portion.

3. The liquid container according to claim 1, wherein the blocking member comprises a film and the movable member comprises a protrusion protruding toward the film.

4. The liquid container according to claim 1, wherein the movable member comprises a frame and an elastic member positioned on and around an outer surface of the frame.

5. The liquid container according to claim 1, wherein the blocking member comprises a valve mechanism, the valve mechanism comprising:

a valve seat positioned in the case, and having a through hole formed therethrough, wherein the through hole is a portion of the air communication passage;

a valve body configured to contact the valve seat to close the through hole; and an urging member configured to urge the valve body in a direction to close the through hole;

wherein when the movable member moves toward the valve body, the valve body moves away from the valve seat to open the through hole against an urging force of the urging member.

6. The liquid container according to claim 5, wherein the movable member comprises a tubular member extending from the valve body through the through hole, and the tubular member is configured to move together with the valve body while contacting a portion of the valve seat defining the through hole.

7. The liquid container according to claim 6, wherein the valve seat comprises an elastic member.

8. The liquid container according to claim 1, wherein the movable member has a first end and a second end opposite the first end, wherein the first end is positioned closer to the air communication end than the second end is, and the air passage extends from the first end to the second end, wherein the gas-permeable film is positioned in the air passage away from the first end.

9. The liquid container according to claim 1, wherein a width of the air passage increases while approaching the gas-permeable film.

* * * * *